US012637848B2

(12) United States Patent
Städtler et al.

(10) Patent No.: US 12,637,848 B2
(45) Date of Patent: May 26, 2026

(54) OUTLET ELEMENT

(71) Applicant: Neoperl GmbH, Müllheim (DE)

(72) Inventors: Georg Städtler, Müllheim (DE); Alexander Bayer, Schliengen (DE)

(73) Assignee: Neoperl GmbH, Müllheim (DE)

( * ) Notice: Subject to any disclaimer, the term of this patent is extended or adjusted under 35 U.S.C. 154(b) by 310 days.

(21) Appl. No.: 18/036,814

(22) PCT Filed: Oct. 21, 2021

(86) PCT No.: PCT/EP2021/079230
§ 371 (c)(1),
(2) Date: May 12, 2023

(87) PCT Pub. No.: WO2022/106148
PCT Pub. Date: May 27, 2022

(65) Prior Publication Data

US 2024/0018765 A1 Jan. 18, 2024

(30) Foreign Application Priority Data

Nov. 19, 2020 (DE) ..... 202020106635.8

(51) Int. Cl.
*E03C 1/086* (2006.01)
*E03C 1/04* (2006.01)

(52) U.S. Cl.
CPC ..... *E03C 1/086* (2013.01); *E03C 1/0405* (2013.01)

(58) Field of Classification Search
CPC ..... E03C 1/086; E03C 1/0405; E03C 1/02; E03C 1/084; B05B 1/1636; B05B 7/0425
See application file for complete search history.

(56) References Cited

U.S. PATENT DOCUMENTS

| | | | |
|---|---|---|---|
| 4,221,337 A | 9/1980 | Shames et al. | |
| 2014/0300010 A1 | 10/2014 | Zhou | |

FOREIGN PATENT DOCUMENTS

| | | | | |
|---|---|---|---|---|
| CN | 1886561 A | | 12/2006 | |
| CN | 103015493 A | | 4/2013 | |
| CN | 110159797 | * | 8/2019 | ..... E03C 1/08 |
| DE | 3006660 | * | 8/1981 | ..... B05B 1/1609 |
| DE | 3903800 | | 12/2021 | |
| EP | 1672129 | | 6/2006 | |
| EP | 2573283 | | 3/2013 | |
| EP | 2653622 | | 10/2013 | |
| GB | 2505257 | * | 2/2014 | ..... B05B 1/1627 |
| GB | 2505257 A | * | 2/2014 | ..... B05B 1/1627 |
| WO | 2021144749 | | 7/2021 | |

* cited by examiner

*Primary Examiner* — Christopher R Dandridge
(74) *Attorney, Agent, or Firm* — Volpe Koenig

(57) ABSTRACT

An outlet element (1) for a sanitary fitting is provided, which outlet element (1) has a main element (2) and a valve device (3) which is connected to the main element (2) and can be adjusted relative to the main element (2) between at least two switching positions in order to switch over between at least two separate water conduits (4, 5). In order for it to be possible for the outlet element (1) to be fixed to an outlet of a sanitary fitting in as simple a way as possible, the outlet element (1) has a threaded coupling (13) with an external thread (19), the threaded coupling (13) being formed on the main element (2).

14 Claims, 8 Drawing Sheets

OUTLET ELEMENT

CROSS-REFERENCE TO RELATED APPLICATIONS

This application is a 371 National Phase of International Application No. PCT/EP2021/079230, filed Oct. 21, 2021, which claims priority to German Patent Application No. 20 2020 106 635.8, filed Nov. 19, 2020, both of which are incorporated herein by reference as if fully set forth.

TECHNICAL FIELD

The invention relates to an outlet element for a sanitary fitting with a main element with at least one outlet opening, and a valve device which interacts with the main element, and with an actuating element, by way of which the valve device is adjustable, in particular rotatable, relative to the main element, in order to switch over between at least two separate water conduits.

BACKGROUND

An outlet element of this type is previously known from document EP 2 573 283 A1. The outlet element which is previously known from said document has a main element with at least one passage opening, which main element is intended for connecting to the outlet of a sanitary fitting. Furthermore, the outlet element has a device which interacts with the main element, a sleeve for fixing the device on the outlet, and an actuating element, protruding out of the sleeve, for the device, the device being rotatable with respect to the main element. The previously known outlet element is distinguished by the fact that the sleeve is provided for non-rotatable holding of the main element in the outlet, the device is a valve device which interacts with the main element for switching over between at least two separate water conduits, and the actuating element serves to actuate the valve device in such a way that one of the two separate water conduits is switched on and remains switched on until a switchover is carried out by the user again to the other water conduit.

The sleeve of the outlet element therefore serves not only to receive the actuating element for the device at least partially within itself, but rather also to fix the main element non-rotatably on the outlet of the sanitary fitting which is to be provided with the outlet element.

SUMMARY

It is an object of the invention to provide an outlet element of the type mentioned at the outset which has a simpler construction in comparison with the previously known outlet element.

An outlet element with one or more of the features disclosed herein directed to an outlet element of this type is provided to achieve the object. In particular, it is therefore provided to achieve the object that the outlet element has a threaded coupling with an external thread, the threaded coupling being formed on the main element and being configured for holding the main element captively to the outlet.

In comparison with the outlet element previously known from document EP 2 573 283 B1, the outlet element according to the invention can therefore be fixed on the outlet of a sanitary fitting without a separate sleeve. A separate fastening sleeve, as is provided in the case of the outlet element of document EP 2 573 283 B1, can therefore be dispensed with. This simplifies the construction according to the invention and facilitates production and mounting thereof which are as simple as possible. While the outlet element which is previously known from the prior art is fixed by means of its sleeve on the sanitary fitting, this takes place in the case of the outlet element according to the invention via the external thread of the threaded coupling which is formed on the main element.

Here, the threaded coupling and the main element can form a materially homogeneous and/or monolithic unit.

In the case of one embodiment of the outlet element, the actuating element can be arranged on the outflow side of the threaded coupling. The threaded coupling is preferably arranged on an inflow side of the main element.

Furthermore, on its outflow side, the main element can have a projection, via which the valve device can be connected or is connected to the main element. With the aid of the projection, the main element and the valve device can be connected to one another to form one unit. It can be advantageous in this context if the valve device has a corresponding plug-in receptacle for the projection of the main element on its inflow side. Here, the outflow side can face away from the threaded coupling of the outlet element.

It is to be mentioned at this point that the reversed arrangement of projection and plug-in receptacle is also conceivable. In the case of one embodiment of the outlet element, the valve device can thus have, on its inflow side, a projection for connection to the main element. Correspondingly, the main element can then have a plug-in receptacle for the projection of the valve device.

The above-mentioned projections can be of annular configuration. Furthermore, it is possible that the projection of the main element is formed on the main element. It is likewise possible that the valve device has a projection which is annular and/or is formed on the valve device. The element which does not have any projection, that is to say either the valve device or the main element, can then be plugged onto the projection for the purpose of connection of the valve device to the main element. Here, the valve device can engage over the projection and/or surrounded on the outer side.

The valve device can preferably be rotated relative to the main element with the aid of the actuating element of the outlet element, in order to switch over the valve device and the main element relative to one another between the at least two switching positions of the at least two water conduits which are separate from one another.

The valve device and/or at least one part of the main element, in particular a, for example the above-mentioned, projection of the main element, can be arranged at least partially within a receiving space defined by the actuating element. The actuating element can be configured as an actuating sleeve which receives at least one part of the main element and/or the valve device within itself. In the case of one embodiment of the actuating element, the latter has an actuating wing which, for example, can project, in particular, radially outward from the main body of the actuating element, in order to be readily accessible for a user of the outlet element.

In the case of one embodiment of the outlet element, it is provided that the actuating element is fixed axially on the valve device.

The actuating element can be configured to actuate the valve device in such a way that one of the at least two separate water conduits is switched on and remains switched on until a switchover is carried out by the user again to the other water conduit.

In the case of one embodiment of the outlet element, at least one notch and at least one matching protrusion are configured between the main element and the valve device (3), which notch and protrusion define at least one switching position of the valve device relative to the main element in a latched position. This can improve the operation of the outlet element and its switching accuracy. At least one notch is preferably configured on the main element, in particular on its projection, and at least one protrusion is configured on the valve device.

BRIEF DESCRIPTION OF THE DRAWINGS

The invention will be described in greater detail in the following text on the basis of exemplary embodiments, but is not restricted to the exemplary embodiments which are shown. Further exemplary embodiments result from combination of the features of individual or multiple claims among one another and/or in a combination of individual or multiple features of the exemplary embodiments.

In the figures.

DETAILED DESCRIPTION

Figure 1:
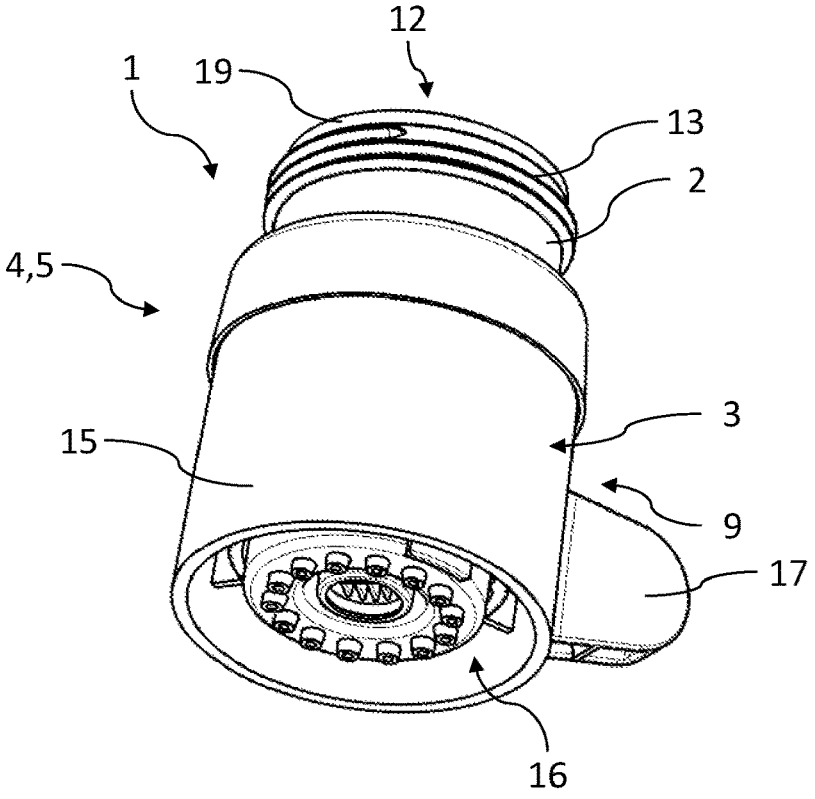
FIG. 1 shows a perspective view of an outlet element.
Figure 2:
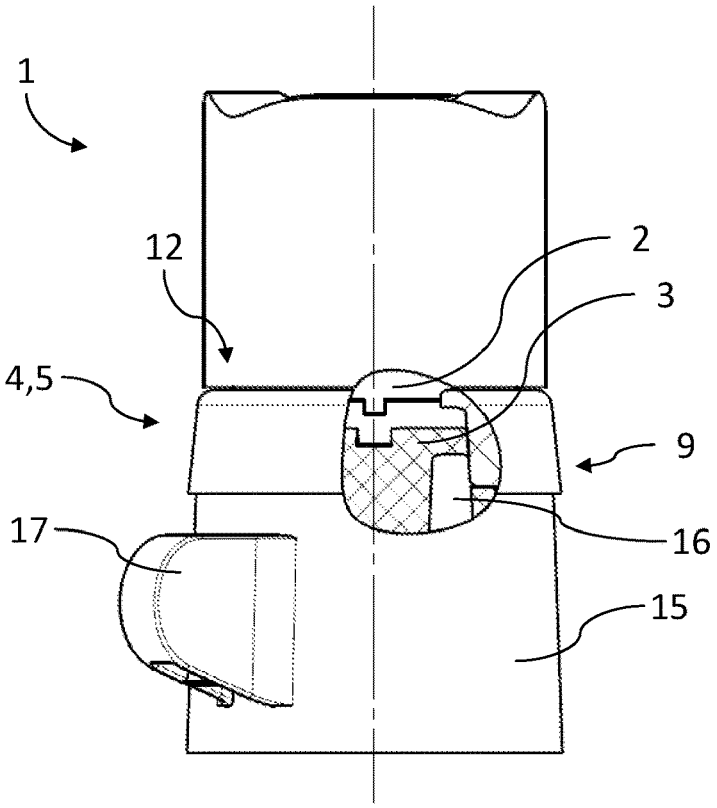
FIG. 2 shows a partially broken-open side view of the outlet element shown in FIG. 1.

All of the Figures show at least parts of an outlet element which is denoted overall by 1. The outlet elements 1 are suitable for use in or on a sanitary fitting. Each outlet element 1 has a main element 2 which is intended for connecting to an outlet of the sanitary fitting. Furthermore, each outlet element 1 comprises a valve device 3 which interacts with the main element 2 and is adjustable (rotatable in the specific exemplary embodiments of the outlet elements 1) relative to the main element 2 between at least two switching positions in order to switch over between at least two separate water conduits 4 and 5.

Each main element 2 has at least one outflow-side outlet opening 6. In the specifically shown embodiments of the outlet element 1, there are two outlet openings 6. Each water conduits 4 and 5 are assigned in each case two inflow-side inlet openings 7 and 8 of the valve device 3.

It is provided in all the outlet elements 1 which are shown that the respective main element 2 has a sealing element 9, by way of which, in each of the at least two switching positions, a transition between the two outflow-side outlet openings 6 of the main element 2 and the two inflow-side in the openings 7 and 8 of the respectively connected water conduits 4 and 5 can be sealed.

The Figures show that the respective main element 2 has a seal seat 10, in which the sealing element 9 is arranged. It becomes clear on the basis of FIGS. 22 and 23, for example, that the seal seat 10 and the sealing element 9 are arranged and configured in such a way that, in each of the at least two switching positions, right-angled projections of two of the inlet openings 7 and 8 lie on the main element 2 within an outer edge of the seal seat 10 and also the seal element 9 and, in addition, within a cross section, delimited by the seal seat 10, of the main element 2.

Figure 22:
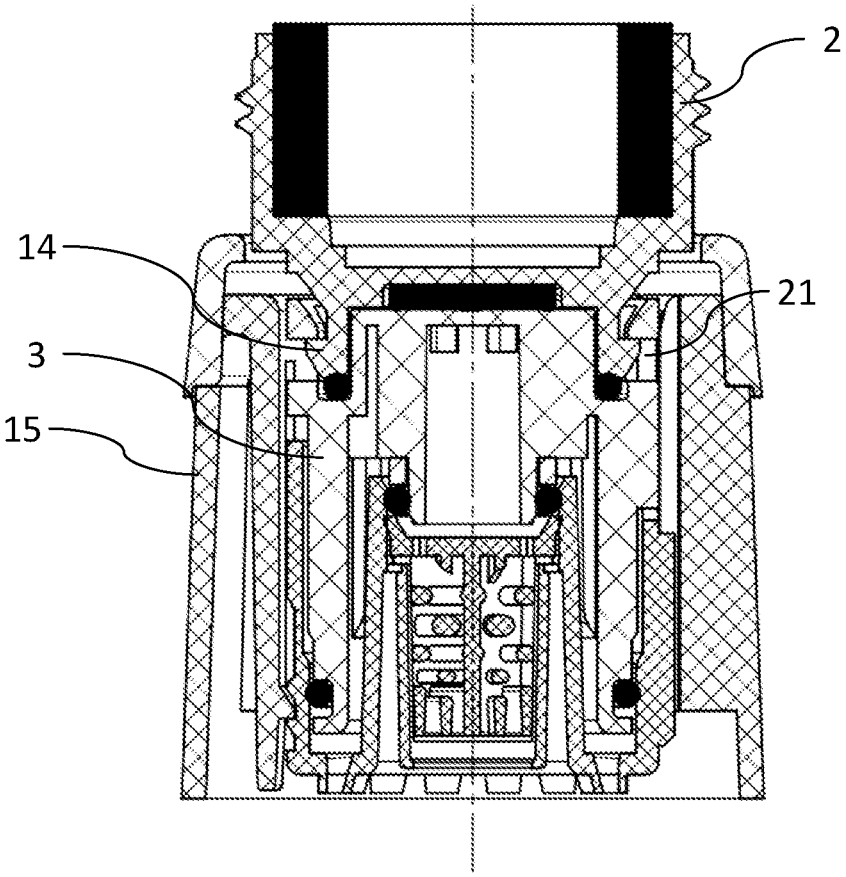
FIG. 22 shows a sectional illustration of the valve device shown in FIG. 21.

FIG. 22 shows the seal seat 10 with the sealing element 9 in the case of a valve device 3 which is situated in a first switching position. It can be clearly seen that the inflow-side inlet openings 7 of the valve device 3 are arranged in such a way that perpendicular projections of the inlet openings 7 lie on the main element 2 within the outer edge of the seal seat 10 and the outer edge of the sealing element 9 and, in addition, within a cross section, delimited by the seal seat 10, of the main element 2.

The same applies in the case of a valve device 3 which is situated in a second switching position with the inflow-side inlet openings 8 of the second water conduits 5 of the valve device 3. This can be seen clearly in FIG. 23.

Figure 8:
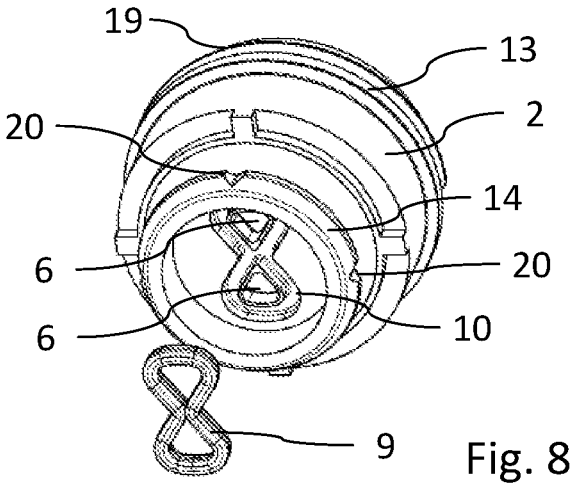
FIG. 8 shows a perspective plan view of an outflow side of the main element; a seal seat and an hourglass-shaped sealing element can be seen.
Figure 9:
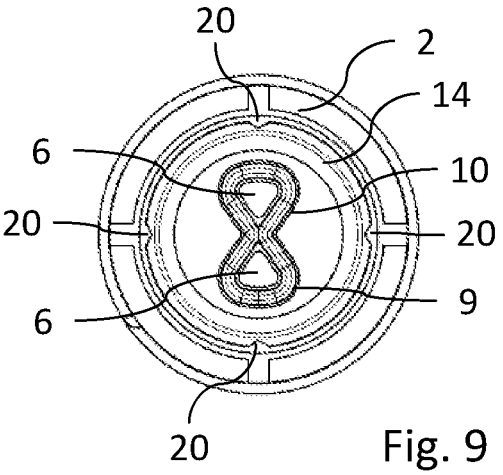
FIGS. 9 and 10 shows perspective plan views of the outflow side of the main element shown in FIGS. 6-8 with a sealing element which is positioned in the seal seat.
Figure 10:
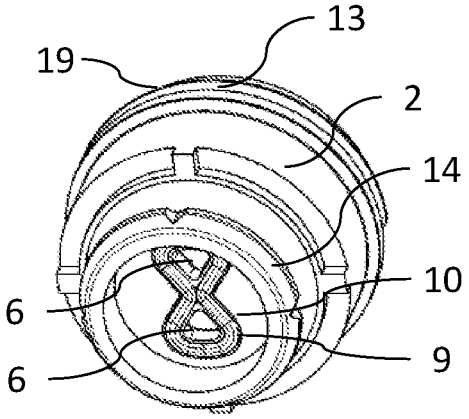
Figure 11:
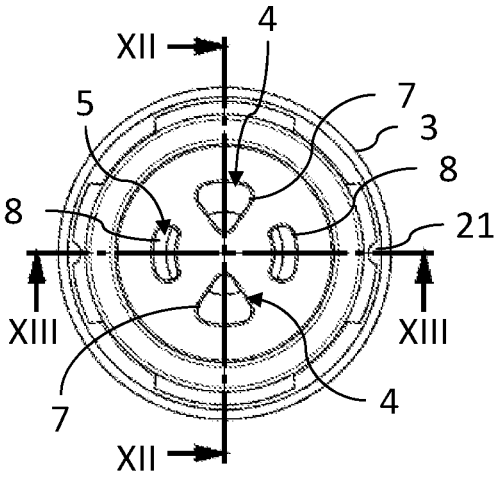
FIG. 11 shows a plan view of an inflow side of the valve device.
Figure 12:
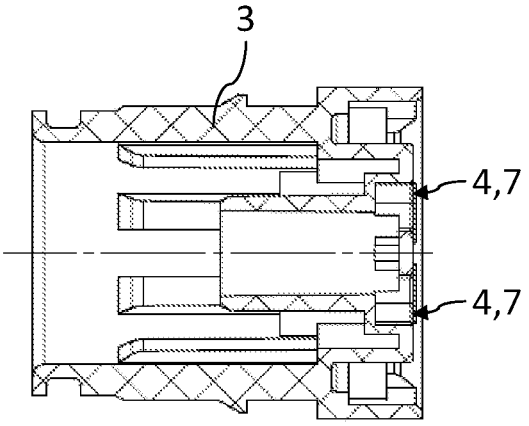
FIG. 12 shows a side view of the valve device, sectioned along the marked sectional line denoted by XII-XII in FIG. 11.
Figure 13:
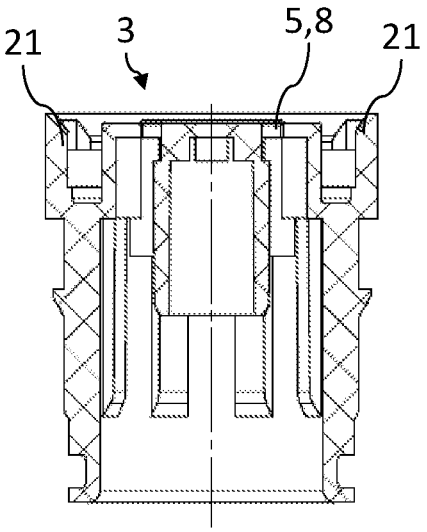
FIG. 13 shows a side view of the valve device, sectioned along the marked sectional line denoted by XIII-XIII in FIG. 11.
Figure 14:
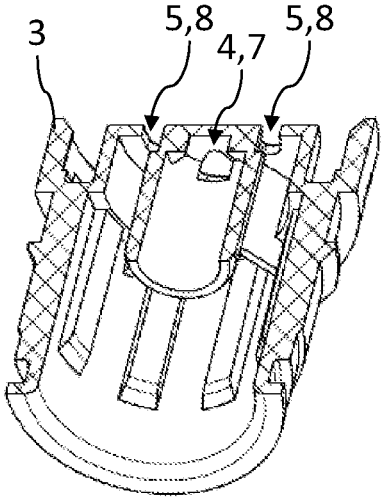
FIG. 14 shows a perspective view of the valve device, sectioned along the marked sectional line denoted by XIII-XIII in FIG. 11.
Figure 15:
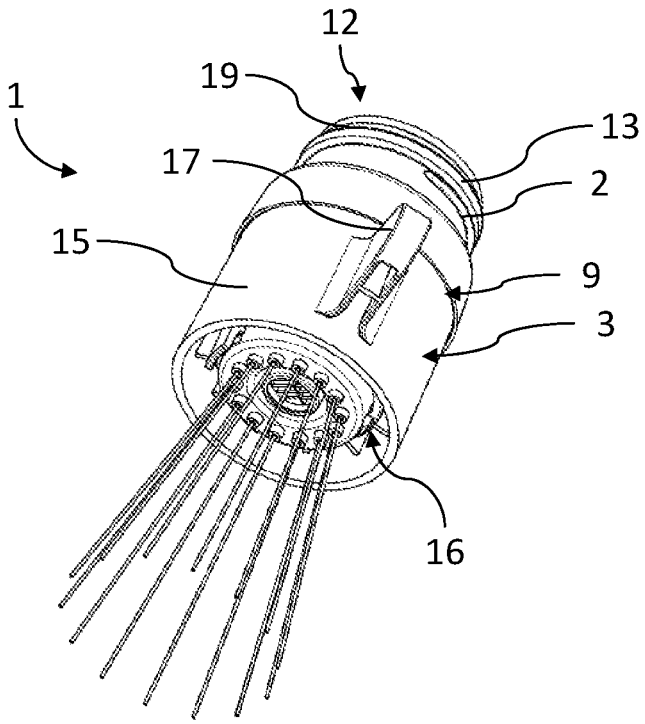
FIG. 15 shows a perspective view of the outlet element with a valve device which is situated in a spray position.
Figure 16:
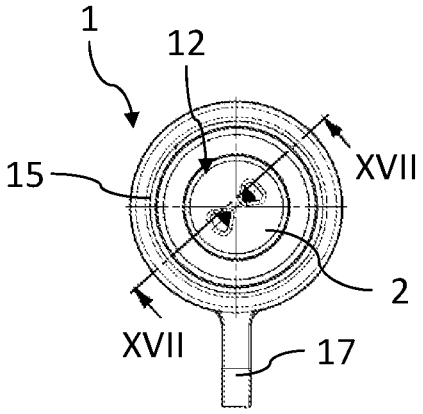
FIG. 16 shows an inflow-side plan view of the illustration shown in FIG. 15.
Figure 17:
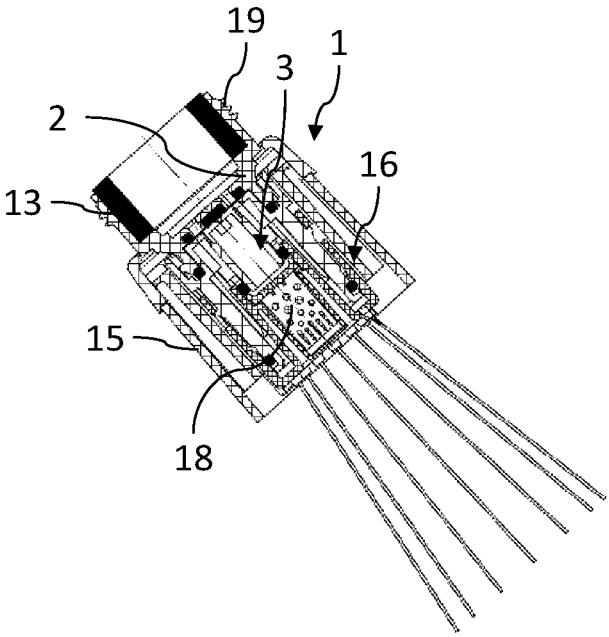
FIG. 17 shows the element shown in FIG. 16 in a side view which is sectioned in FIG. 16 with a sectional line denoted by XVII-XVII.
Figure 18:
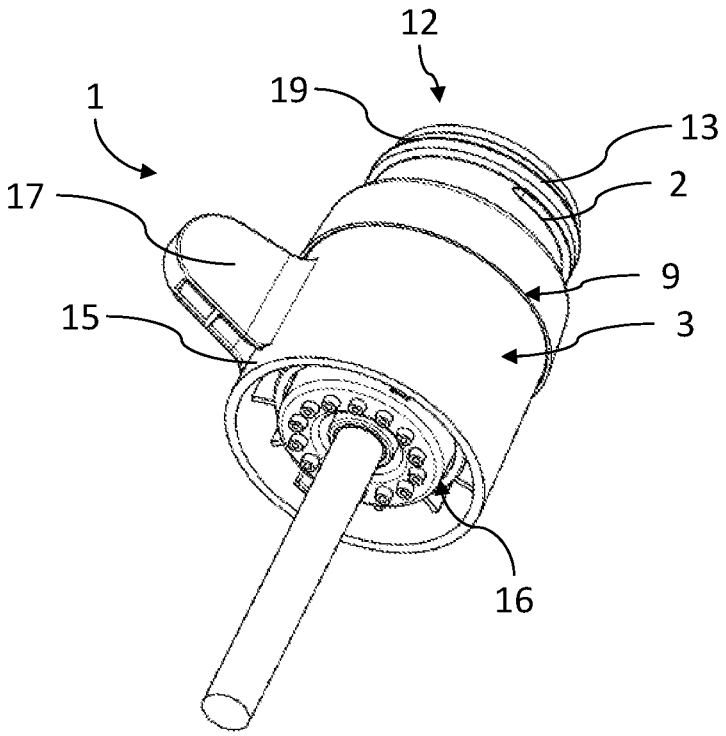
FIG. 18 shows a perspective view of the outlet element, the valve device being set in such a way that the outlet element outputs a central single jet.
Figure 19:
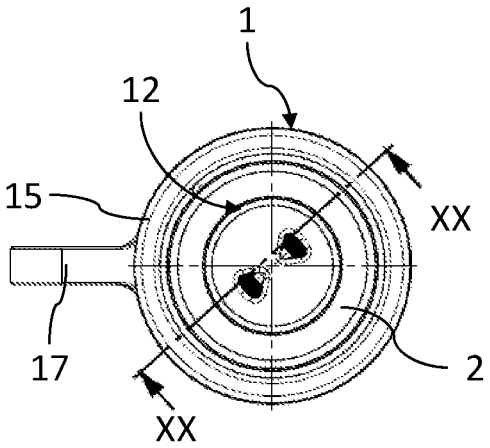
FIG. 19 shows a plan view of an inflow side of the outlet element shown in FIG. 18.
Figure 20:
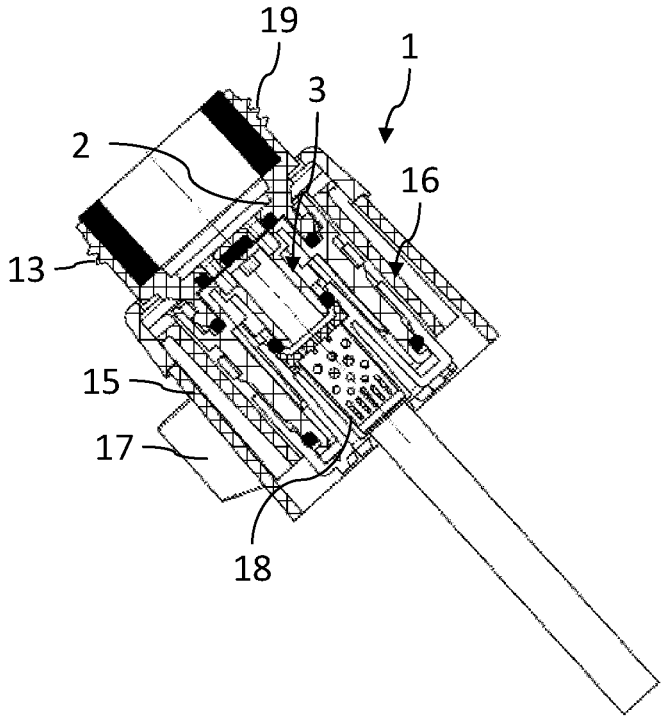
FIG. 20 shows an illustration, sectioned along the sectional line denoted by XX-XX in FIG. 19, of the outlet element shown in FIG. 19.
Figure 21:
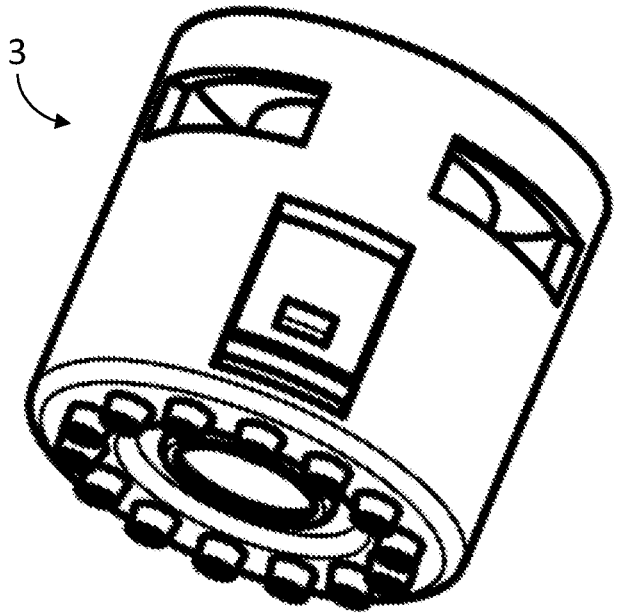
FIG. 21 shows a perspective illustration of the valve device of the outlet element shown in the previous Figures in order to illustrate fixing of the actuating element on the valve device.

According to FIGS. 8-10, the seal seat 10 is configured on an outflow side 11 of the main element 2. The inlet openings 7 of the water conduits 4 noticeably differ with regard to their shape and size from the inlet openings 8 of the second water conduits 5 of the valve device 3.

The two outlet openings 6 of the main element 2 and at least one of the inlet openings 7 and 8 of one of the at least two water conduits 4, 5 of the valve device 3 have the same cross section or at least approximately the same cross section. According to FIGS. 22 and 23, they are the inflow-side inlet openings 8 of the second water conduits.

The seal seat 10 is configured as an endless receiving groove and receives the sealing element 9 within itself. The sealing element 9 can be called a seal ring in a figure-of-eight shape or else an hourglass-shaped seal ring.

The Figures illustrate that the main element 2 has, on its inflow side 12, a threaded coupling 13, by way of which it can be screwed, for example, to an outlet piece of a sanitary fitting. An external thread 19 is configured on the threaded coupling 13, by way of which external thread 19 the outlet element 1 can be fastened via its main element 2 to an outlet of a sanitary fitting. The threaded coupling 13 is formed on the main element 2 and is configured to hold the main element 2 captively on an outlet of a sanitary fitting.

On its outflow side 11, the main element 2 has a projection 14, by which the valve device 3 is connected to the main element 2. The projection 14 is of annular configuration and is formed on the main element 2, namely on the outflow side 11. In the use position, the valve device 3 is plugged onto the projection 14 of the main element 2. The valve device 3 thus engages over the projection 14 and surrounds it on the outer side.

The outlet element 1 has an actuating element 15, by way of which the valve device 3 is adjustable, namely rotatable, relative to the main element 2, in order to switch over between the two separate water conduits 4 and 5. In all the embodiments which are shown of the outlet element 1, the actuating element 15 is arranged on the outflow side of the threaded coupling 13.

In the case of the two outlet elements 1 which are shown in the figures, the actuating elements 15 are configured in such a way that the valve device 3 and the projection 14 of the main element 2 are arranged at least partially within a receiving space 16 defined by the actuating element 15. The actuating elements 15 are therefore actuating sleeves which can receive the valve device 3 and the projection 14 of the main element 2 at least partially within themselves.

The actuating elements 15 of the outlet elements 1 which are shown are fixed axially on the respective valve device 3.

Each of the actuating elements 15 has at least one actuating wing 17.

The respective actuating element 15 is configured to actuate the valve device 3 which is connected to it, in such a way that one of the at least two separate water conduits 4, 5 is switched on and remains switched on until a switchover is carried out again by the user to the other water conduits 4 or 5.

Figure 3:
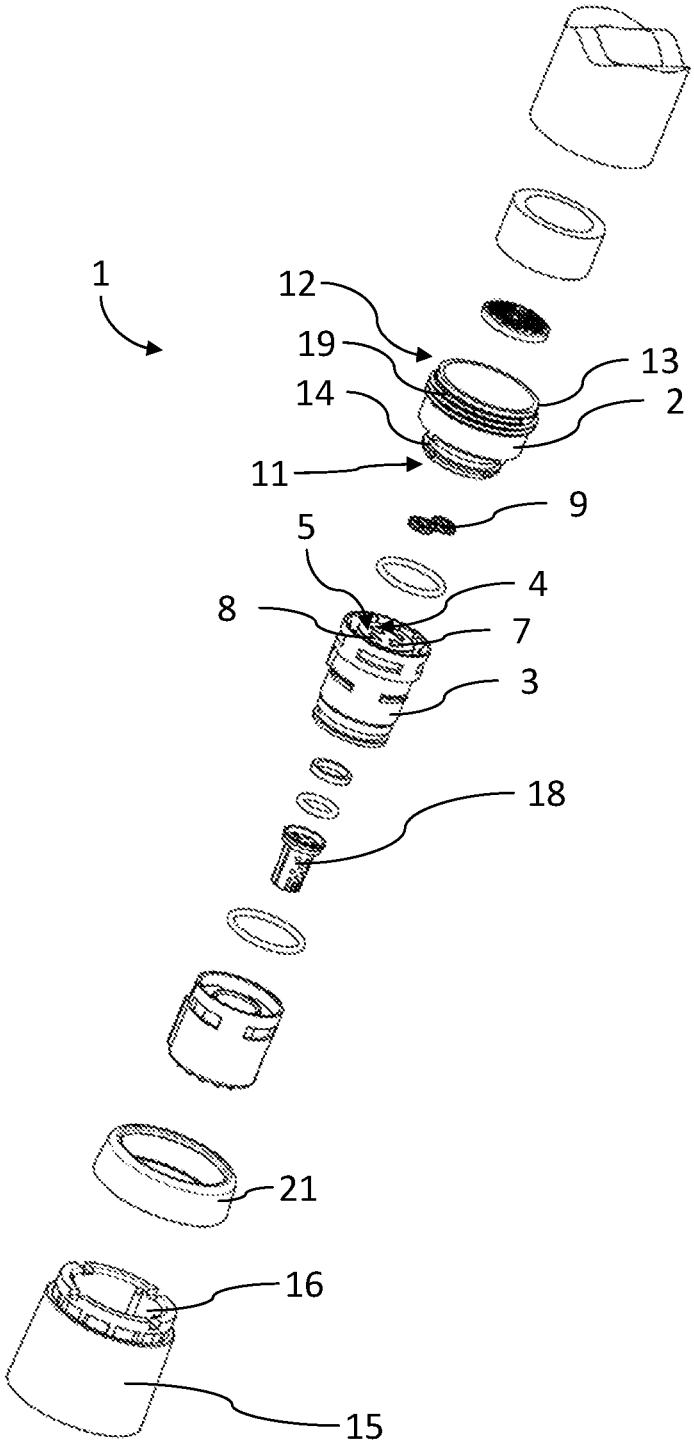
FIG. 3 shows a perspective exploded illustration of the outlet element which is shown in the two previous figures.
Figures 4, 5:
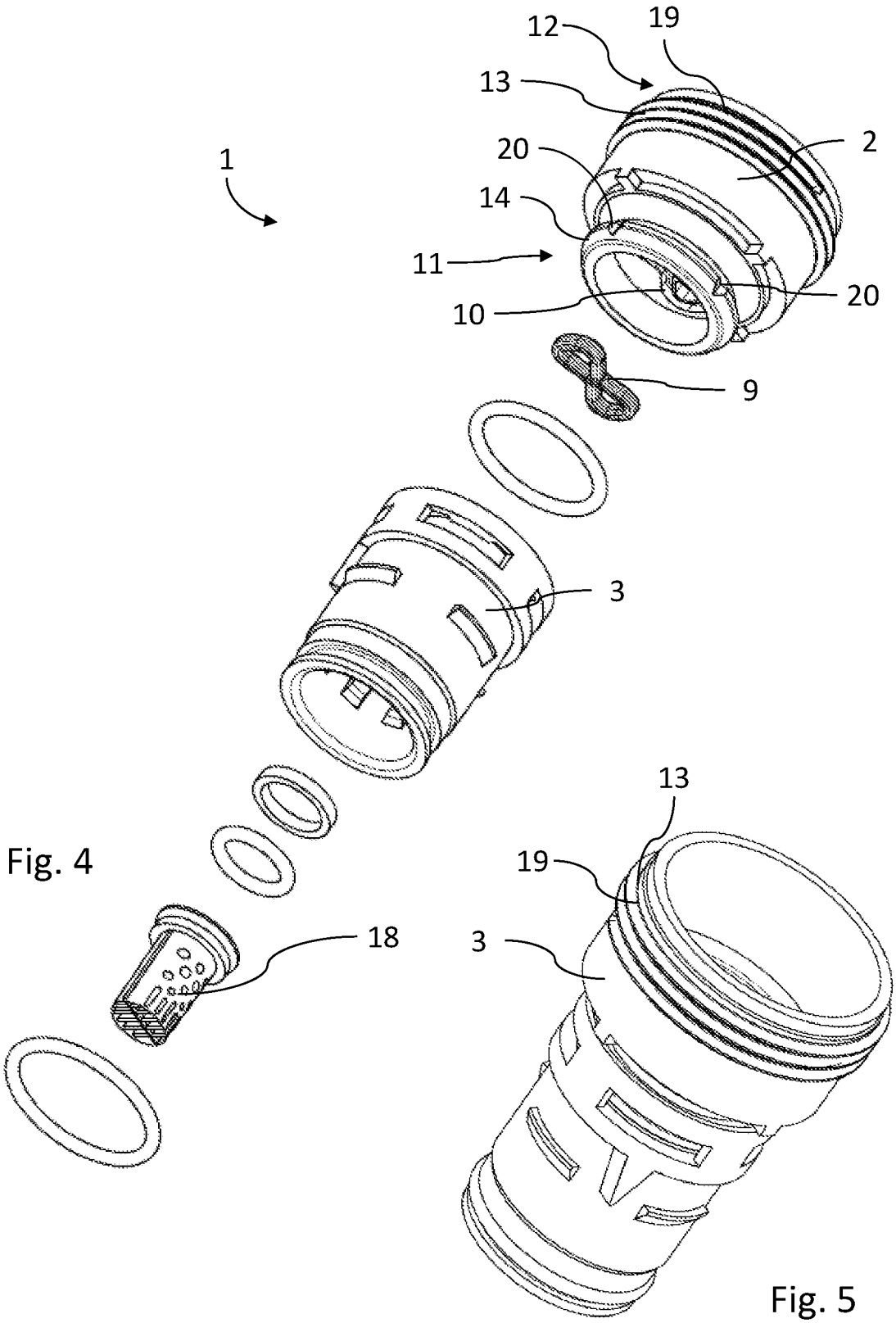
FIG. 4 shows a perspective exploded illustration of a main element of the outlet element with a sealing element, and a valve device, assigned to the main element, of the outlet element, which valve device is adjustable between at least two switching positions relative to the main element in order to switch over between at least two separate water conduits.
FIG. 5 shows a perspective view of the valve device shown in FIGS. 3 and 4, FIGS. 6 and 7 show plan views of an inflow side of the main element.
Figure 6:
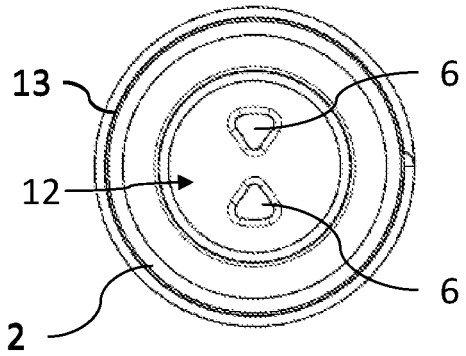
Figure 7:
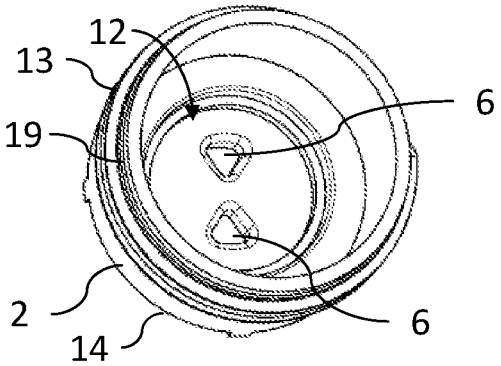

FIGS. 3 and 4 show a jet splitter 18 which, according to the exploded illustrations of the outlet element 1 of FIGS. 3 and 4, is part of the valve device 3 of the outlet element 1.

FIGS. 4 and 8 to 10 show that a total of four notches 20 which are offset at a 90° angle with respect to one another are configured on the projection 14 of the main element 2. The notches 20 define switching positions of the actuating element 15 and the valve device 3.

Two inwardly directed protrusions 21 which match the notches 20 are configured on an inner side of the valve device 3. The protrusions 21 latch into the notches 20 when the valve device 3 is moved into the switching positions by way of the actuating element 15.

It can be seen in the sectional illustration of FIG. 22 how the actuating element 15 is fastened to the valve device 3. Furthermore, FIG. 22 shows that the main element 2 is snapped to the valve device 3.

The invention is concerned with improvements in the field of sanitary technology. An outlet element 1 for a sanitary fitting is thus provided, which outlet element 1 has a main element 2 and a valve device 3 which is connected to the main element 2 and can be adjusted relative to the main element 2 between at least two switching positions in order to switch over between at least two separate water conduits 4, 5. In order for it to be possible for the outlet element 1 to be fixed to an outlet of a sanitary fitting in as simple a way as possible, the outlet element 1 has a threaded coupling 13 with an external thread 19, the threaded coupling 13 being formed on the main element 2.

LIST OF DESIGNATIONS

1 Outlet element
2 Main element
3 Valve device
4 First water conduit
5 Second water conduit
6 Outflow-side outlet opening on 2
7 Inflow-side inlet opening of 4
8 Inflow-side inlet opening of 5
9 Sealing element
10 Seal seat
11 Outflow side of 2
12 Inflow side of 2
13 Threaded coupling
14 Projection
15 Actuating element
16 Receiving space of 15
17 Actuating wing
18 Jet splitter
19 External thread
20 Notch
21 Protrusion

The invention claimed is:

1. An outlet element (1) for a sanitary fitting, the outlet element (1) comprising:

a main element (2) adapted for connection to a sanitary fitting outlet of the sanitary fitting, the main element (2) comprising at least two outflow-side outlet openings (6) arranged on an outflow side of the main element (2), a seal receiver (10) arranged on the outflow side of the main element (2), and a sealing element (9) arranged in the seal receiver (10), the sealing element (9) having at least two openings that are separated from one another and correspond to the at least two outflow-side outlet openings (6) of the main element (2);

a valve device (3) which interacts with the main element (2), the valve device (3) comprising at least two pairs of inflow-side inlet openings (7, 8);

an actuating element (15), by which the valve device (3) is adjustable relative to the main element (2), in order to switch over between at least two separate water conduits (4, 5), wherein a first water conduit (4) of the at least two separate water conduits (4, 5) is assigned to a first pair of inflow-side inlet openings (7) of the at least two pairs of inflow-side inlet openings (7, 8), and wherein a second water conduit (5) of the at least two separate water conduits (4, 5) is assigned to a second pair of inflow-side inlet openings (8) of the at least two pairs of inflow-side inlet openings (7, 8), wherein, in each of at least two switching positions a passage is sealable by the sealing element (9) between the at least two outflow-side outlet openings (6) of the main element (2) and the at least two pairs of inflow-side inlet openings (7, 8) of the at least two separate water conduits (4, 5); and a threaded coupling (13) with an external thread (19), the threaded coupling (13) being formed on the main element (2) and being configured for holding the main element (2) captively to the sanitary fitting outlet.

2. The outlet element (1) as claimed in claim 1, wherein the actuating element (15) is arranged on an outflow side of the threaded coupling (13).

3. The outlet element (1) as claimed in claim 1, wherein, on an outflow side (11) which faces away from the threaded coupling (13), the main element (2) has a projection (14), via which the valve device (3) is connected to the main element (2).

4. The outlet element (1) as claimed in claim 3, wherein the projection (14) is formed on the main element (2).

5. The outlet element (1) as claimed in claim 3, wherein at least one of the valve device (3) or the projection (14) of the main element (2) is arranged at least partially within a receiving space (16) defined by the actuating element (15).

6. The outlet element (1) as claimed in claim 1, wherein the actuating element (15) is fixed axially on the valve device (3).

7. The outlet element (1) as claimed in claim 1, wherein the actuating element (15) is configured to actuate the valve device (3) such that one of the two separate water conduits (4, 5) is switched on and remains switched on until a switchover is carried out by a user again to an other of the water conduits (4, 5).

8. The outlet element (1) as claimed in claim 1, further comprising, at least one notch (20) and at least one matching protrusion (21) being configured between the main element (2) the valve device (3), the notch (20) and the protrusion (21) define at least one switching position of the valve device (3) relative to the main element (2) in a latched position.

9. The outlet element (1) as claimed in claim 8, wherein the at least one notch (20) is configured on the main element (2), and the at least one protrusion (21) is configured on the valve device (3).

10. The outlet element (1) as claimed in claim 9, wherein the main element (2) has a projection (14), via which the valve device (3) is connected to the main element (2), and the at least one notch (20) is located on the projection (14).

11. The outlet element (1) as claimed in claim 1, wherein the valve device (3) is rotatable relative to the main element (2).

12. The outlet element (1) as claimed in claim 3, wherein the projection (14) is annular.

13. The outlet element (1) as claimed in claim 3, wherein the valve device (3) is plugged onto the projection (14).

14. The outlet element (1) as claimed in claim 13, wherein the valve device (3) at least one of engages over or surrounds an outer side of the projection (14).

* * * * *